US009964883B2

(12) United States Patent
Sambhy et al.

(10) Patent No.: US 9,964,883 B2
(45) Date of Patent: May 8, 2018

(54) WHITE DRY INK PULVERIZED TONER COMPOSITION AND FORMULATION THEREOF

(71) Applicant: XEROX CORPORATION, Norwalk, CT (US)

(72) Inventors: Varun Sambhy, Pittsford, NY (US); Kirk L. Stamp, Rochester, NY (US); Juan A. Morales-Tirado, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/170,929

(22) Filed: Jun. 1, 2016

(65) Prior Publication Data

US 2017/0351190 A1 Dec. 7, 2017

(51) Int. Cl.

| | |
|---|---|
| ***G03G 9/09*** | (2006.01) |
| ***B41M 5/50*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0902* (2013.01); *B41M 5/502* (2013.01); *G03G 9/0808* (2013.01); *G03G 9/0819* (2013.01); *G03G 9/0821* (2013.01); *G03G 9/0823* (2013.01); *G03G 9/08755* (2013.01); *G03G 9/08793* (2013.01); *G03G 9/09708* (2013.01); *G03G 9/09716* (2013.01); *G03G 9/09725* (2013.01); *G03G 9/09783* (2013.01)

(58) Field of Classification Search

CPC ..... G03G 9/0902; G03G 9/08755

See application file for complete search history.

(56) References Cited

U.S. PATENT DOCUMENTS

| | | | | |
|---|---|---|---|---|
| 5,516,614 | A * | 5/1996 | Nash | G03G 9/0823 430/108.3 |
| 2009/0296173 | A1* | 12/2009 | Mestha | G03G 15/01 358/518 |
| 2011/0052882 | A1* | 3/2011 | Gong | G03G 9/0812 428/195.1 |
| 2013/0115549 | A1* | 5/2013 | Yang | G03G 9/0823 430/105 |
| 2013/0337376 | A1* | 12/2013 | Watanabe | G03G 9/08748 430/108.1 |
| 2015/0362872 | A1* | 12/2015 | Kawamura | G03G 15/6585 430/105 |

* cited by examiner

*Primary Examiner* — Peter L Vajda
(74) *Attorney, Agent, or Firm* — Caesar Rivise, PC

(57) ABSTRACT

An apparatus and method of manufacturing a white dry ink pulverized toner including a resin and 15%-45% TiO2 pigment having a mean size of 100-350 nm melt mixed with the resin in a twin screw extruder resulting in an extruded mix. The extruded mix is pulverized in a fluid bed jet mill. Fines of the pulverized extruded mix less than 5 microns may be removed from the pulverized extruded mix by classification leaving pulverized particles having a mean size of 6-12 microns. The pulverized particles are blended in a mixer with surface additives including silica and ZnSt, and the white dry ink pulverized toner has a developer charge between 5 and 50 μC/gram and a Lightness (L*) of at least 75 at a toner mass per unit area (TMA) of at most 1.2 mg/cm$^2$.

20 Claims, 8 Drawing Sheets

| TONER | TiO2 PIGMENT LOADING (%) | MEDIAN SIZE (MICRONS) |
|---|---|---|
| EXAMPLE 1 | 25 | 8.3 |
| EXAMPLE 2 | 20 | 8.3 |
| EXAMPLE 3 | 30 | 8.3 |
| EXAMPLE 4 | 40 | 8.3 |
| EXAMPLE 5 | 18 | 12 |
| EXAMPLE 6 | 25 | 12 |

| TONER | TiO2 PIGMENT LOADING (%) | MEDIAN SIZE (MICRONS) | L*@TMA OF 1.2 mg/cm2 |
|---|---|---|---|
| EXAMPLE 1 | 25 | 8.3 | 75 |
| EXAMPLE 4 | 40 | 8.3 | 80 |
| EXAMPLE 5 | 18 | 12 | 75 |
| EXAMPLE 6 | 25 | 12 | 75 |

| %PIGMENT | 3K JOULES | 6K JOULES | 9K JOULES |
|---|---|---|---|
| 0% (CYAN CONTROL) | 62 | 49 | 42 |
| 20% | 60 | 50 | 38 |
| 30% | 61 | 52 | 41 |
| 40% | 64 | 56 | 46 |

FIG. 7

| ENVIRONMENT | 25% PIGMENT | CONTROLS |
|---|---|---|
| A ZONE (HIGH HUMIDITY) | 10-12 | 10-13 |
| B ZONE (LAB AMBIENT) | 25-28 | 26-36 |
| J ZONE (LOW HUMIDITY) | 35-40 | 32-44 |

FIG. 8

| TONER | TiO2 PIGMENT LOADING (%) | MEDIAN SIZE (MICRONS) | A ZONE TRIBO | B ZONE TRIBO | J ZONE TRIBO |
|---|---|---|---|---|---|
| EXAMPLE 1 | 25 | 8.3 | 11.15 | 27.87 | 39.79 |
| EXAMPLE 2 | 20 | 8.3 | 14.67 | 27.89 | 41.74 |
| EXAMPLE 3 | 30 | 8.3 | 11.34 | 25.01 | 35.39 |
| EXAMPLE 4 | 40 | 8.3 | 12.73 | 21.37 | 30.6 |
| EXAMPLE 5 | 18 | 12 | 8.02 | 19.36 | 28 |
| EXAMPLE 6 | 25 | 12 | 7.34 | 17.08 | 23.6 |

FIG. 9

WHITE DRY INK PULVERIZED TONER COMPOSITION AND FORMULATION THEREOF

FIELD OF DISCLOSURE

The disclosure relates to toner compositions, and more specifically, to white pulverized toner compositions and processes for making same.

BACKGROUND OF THE INVENTION

Electrophotographic printing uses toner particles which may be produced by a variety of processes. One such process includes an emulsion aggregation ("EA") process that forms toner particles in which surfactants are used in forming a latex emulsion. See, for example, U.S. Pat. Nos. 6,120,967 and 8,617,780. Another such process vastly different than EA includes a pulverization method wherein a mixture is crushed into a toner powder.

White toner may be used to print or make a white background on a black or colored substrate, such as print media, or on a transparent substrate, like film. The white toner must have sufficient masking or hiding power over the substrate while maintaining acceptable charging.

BRIEF SUMMARY OF THE INVENTION

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a white dry ink pulverized toner including a resin and 15 to 45% ($TiO_2$) pigment having a mean size of 250-350 nm melt mixed with the resin in a twin screw extruder resulting in an extruded mix. The extruded mix is pulverized in a fluid bed jet mill followed by classification to remove particles less than 5 microns (called fines) to finally yield target toner particles with a median size between 7 to 12 microns. The pulverized particles are blended in a mixer with surface additives including silica, titania and zinc stearate (ZnSt), and the white dry ink pulverized toner has a developer charge between 10 and 50 μC/gram and a Lightness (L*) of at least 75 at a toner mass per unit area (TMA) of less than or equal to 1.2 mg/cm$^2$.

The exemplary embodiments may include a method of producing white dry ink pulverized toner, with the method including mixing and extruding 15%-45% $TiO_2$ pigment having a mean size of 250-350 nm with a resin in a twin screw extruder resulting in an extruded mix, pulverizing the extruded mix in a fluid bed jet mill to a target median size of less than 8 microns, removing fines of the pulverized extruded mix less than 5 microns by classification leaving pulverized particles having a mean size of greater than 8.0 microns, and adding surface additives including silica, titania and zinc stearate to the pulverized particles and blending the surface additives and pulverized particles resulting in the white dry ink pulverized toner, wherein the white dry ink pulverized toner has a developer charge between 10 and 50 μC/gram and a L* of at least 75 at a toner mass per unit area (TMA) of less than or equal to 1.2 mg/cm$^2$.

According to aspects illustrated herein, an image may be formed with a white dry ink pulverized toner on a black substrate. In such an image, the white dry ink pulverized toner includes a resin and 15%-45% $TiO_2$ pigment having a mean size of 250-350 nm melt mixed with the resin in a twin screw extruder resulting in an extruded mix. The extruded mix is pulverized in a fluid bed jet mill to a target median size of less than 8 microns, with fines of the pulverized extruded mix less than 5 microns being removed from the pulverized extruded mix by classification leaving pulverized particles having a mean size of greater than 8.0 microns. The pulverized particles are blended in a mixer with surface additives including silica, titania and ZnSt, and the white dry ink pulverized toner has a developer charge between 10 and 50 μC/gram and a L* of at least 75 at a toner mass per unit area (TMA) of less than or equal to 1.2 mg/cm$^2$.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and:

FIG. 7 is a table showing silica additive attachment results from a white dry ink pulverized toner in accordance with an exemplary embodiment;

FIG. 8 is a table showing triboelectric charge results from a white dry ink pulverized toner in accordance with an exemplary embodiment;

FIG. 9 is a table showing the tribo of toners made from parent particles of Examples 1-6 from FIG. 1;

DETAILED DESCRIPTION OF THE INVENTION

Figures 1, 2:
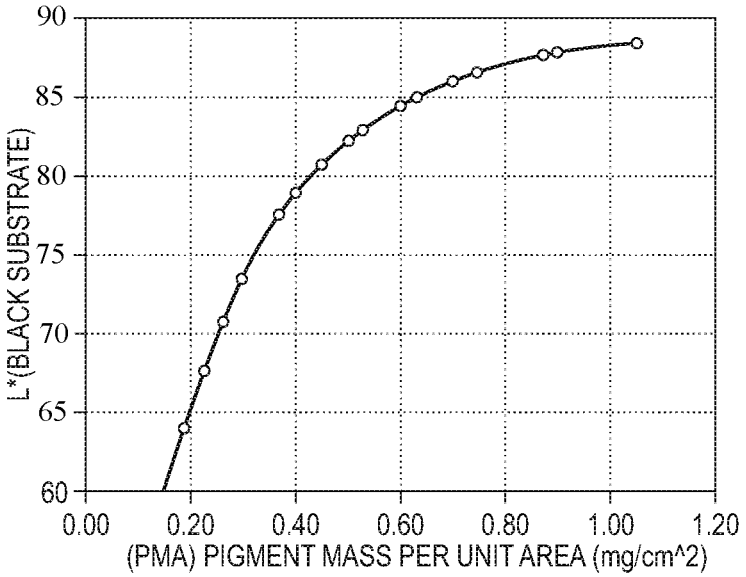
FIG. 1 is a table of a series of particles having different weight percent loading of $TiO_2$ pigment and size prepared in accordance with exemplary embodiments.
FIG. 2 is a graph showing the results of a hiding power Lightness (L*) analysis of exemplary white toner particle layers on a black substrate vs. Pigment Mass per Unit Area.

Illustrative examples of the devices, systems, and methods disclosed herein are provided below. An embodiment of the devices, systems, and methods may include any one or more, and any combination of, the examples described below. This invention, however, may be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "silicone" is well understood to those of skill in the relevant art and refers to polyorganosiloxanes having a backbone formed from silicon and oxygen atoms and sidechains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone rubber, for example nitrogen atoms in amine groups.

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

All physical properties that are defined hereinafter are measured at 20° to 25° Celsius unless otherwise specified. The term "room temperature" refers to 25° Celsius unless otherwise specified.

When referring to any numerical range of values herein, such ranges, are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

While the white dry ink pulverized toner is discussed herein in relation to digital offset printing or variable data lithographic printing systems, embodiments of the white dry ink pulverized toner, or methods of manufacturing imaging members or forming images using the same, may be used for other applications, including printing applications other than digital offset printing or variable data lithographic printing systems.

The examples include a white pulverized toner formulation that can be integrated into a digital printing system. The white pulverized toner achieves industry sufficient hiding power of colors substrates while maintaining charging. Designing a white pulverized toner with sufficient hiding power is challenging because of the high pigment loading required and also the fact that during the pulverization step the pigment is exposed on the surface of the particle. This leads to a more conductive toner surface that cannot retain charge as well as chemical toners that have a polymer shell encapsulating the pigment. The hiding power of the toner has been measured by fusing toner layers with specific mass on black substrates having a lightness (L*) of about 5, and measuring the L* of the white toner layer.

While not being limited to a particular theory, the exemplary white dry ink pulverized toner formulation has a developer charge between 5 and 50 μC/gram and an L* of >75 at a toner mass per unit area (TMA) of less than or equal to 1.2 mg/cm$^2$. In an example, the white dry ink pulverized toner has a developer charge between 10 and 45 μC/gram. In an example, the white dry ink pulverized toner has a Pigment Mass per Unit Area greater than 0.32 mg/cm$^2$.

In an example, the white dry ink pulverized toner includes a resin and 15%-45% TiO2 pigment having a mean size of 250-350 nm melt mixed with the resin in an extruder resulting in an extruded mix. The resin may be a propoxylated bisphenol-A/fumaric acid resin. The resin may include a combination of a propoxylated bisphenol-A/fumaric acid resin and a gel resin made by crosslinking the propoxylated bisphenol-A/fumaric acid resin. In an example, the resin may include a propoxylated bisphenol-A/fumaric acid resin with molecular weight (Mw) of 12000-14000 pse and 10-30% of a gel resin made by crosslinking the propoxylated bisphenol-A/fumaric acid resin.

While not being limited to a particular theory, the TiO2 pigment may have a silica and alumina pre-treatment for improved dispersion in an organic phase. The silica/alumina treatment may be performed before the pigment is extruded with the resins, as would readily be understood by a skilled artisan. The TiO2 pigment may have a mean size of 100-400 nm, a mean size of 250-350 nm, a mean size of 275-325 nm, or even a mean size of 290-310 nm. The extruder may be a twin screw extruder.

The extruded mix is pulverized in a fluid bed jet mill to a target median size of less than 8 microns. In an example, the fluid bed jet mill is a 200 AFG fluid bed jet mill. The target median size of the pulverized extruded mix that is less than 8 microns may be between 7.4 and 7.8 microns.

The pulverized extruded mix may include fines (e.g., particles less than 5 micron in size). In an example, the fines content is between 10-25%, and may be between 15-20%, or even about 18%. These fines may be removed from the pulverized extruded mix, for example, by classification. The removal of the fines leaves pulverized particles having a mean size greater than the target median size of the pulverized extruded mix. In examples, the mean size of the pulverized particles after fine removal is greater than 6.0 microns, and may be 8.1-8.5 microns, about 8.3 microns or even up to and including about 12 microns.

The pulverized particles are blended in a mixer with surface additives. The surface additives may include silica and ZnSt. The surface additives may include titania in addition to the silica and ZnSt. The silica may be between 2-5%, the titania between 0-2% and the ZnST between 0.4-0.6%. In an example, the surface additives include 3.5% NA50HS silica, 1.6% SMT5103 titania, and 0.5% ZnSt.

Aspects of the present disclosure may be further understood by referring to the following examples. The examples are illustrative, and are not intended to be limiting embodiments thereof. Example 1 below illustrates the development and process of making a white dry ink pulverized toner according to one embodiment of the present disclosure.

Exemplary White Dry Ink Pulverized Toner Development and Process

Production of exemplary white parent particles started by extruding the raw materials in a twin screw extruder (e.g., a ZSK-25 extruder commercially available from Coperion). The raw material mix included a propoxylated bisphenol-A/fumaric acid resin with a molecular weight (Mw) of around 13000 pse and 20% of a gel resin made by cross-linking the propoxylated bisphenol-A/fumaric acid resin. The pigment used was a treated TiO2, such as R-706 commercially available from DuPont. This pigment has a mean size of 275-325 nm (e.g., about 300 nm) and has a silica and alumina treatment that enables better dispersion in an organic phase. Pigment levels of 15% to 40% were included with about 25% preferred. The resulting extruded mix was pulverized in a 200 AFG fluid bed jet mill to a target median size of 7.6 microns. The target particle size was selected to enable a mean size of around 8.3 microns after removing the excess fines content of about 18%. 0.3% silica (e.g., TS530 silica commercially available from CAB-O-SIL) was added during the pulverization process as a flow aid. The particles were classified in a tandem toner classifier (e.g., B18 Acucut). A series of particles having different weight percent loading of TiO2 pigment and size were prepared as described above and are listed in the table of FIG. 1.

To assess the quality of the parent toner particles the inventors determined the hiding power, for example, by deposition and fusing of a specific particle amount on a black substrate (L* about 5) and measuring the corresponding L* of the white toner particle layer. L* is the luminous intensity of a color—i.e., its degree of lightness. Lightness means brightness of an area judged relative to the brightness of a similarly illuminated area that appears to be white or highly transmitting. The lightness, L* represents the darkest black at L*=0, and the brightest white at L*=100. Performing this exercise with different toner amounts (TMA) allows plotting L* vs. TMA (Lightness vs. Toner Mass per Unit Area). FIG. 2 depicts a graft showing results of L* vs. PMA (Pigment Mass per Unit Area) where particles with different pigment levels are assessed. It should be noted that PMA is the product of the TMA and the fraction of pigment in the particle. This is shown in FIG. 2. By plotting L* vs. PMA one can consider different combinations of pigment level and TMA yielding the desired L* target. This is important since the toner triboelectric charging (tribo) characteristics are influenced by the fraction of pigment in the particle.

The inventors targeted a white toner with L* greater than or equal to 75 to satisfy viewing expectations. Based on the plot from FIG. 2, the inventors determined that the white toner should have a PMA greater than 0.32, and preferably greater than 0.43 mg/cm$^2$ for sufficient hiding power. Toner particles were evaluated for L* metric at a TMA of 1.2 mg/cm$^2$ as describe above. The results are listed in the table of FIG. 3. Surface Additive Blending The parent particles (Examples 1-6) were blended in a 75 L Henschel Vertical Mixer under a power level of around 290 W/lb, and delivering a total energy of 19.6 W-h/lb. The power and energy levels were set with the impeller speed and blend time. The initial additive packaged used includes 3.5% NA50HS silica, 1.6% SMT5103 Titania, and 0.5% ZnSt. Given the presence of TiO2 in the particle it is highly plausible to alternatively use an additive package including only silica and ZnSt.

Figures 3, 4:
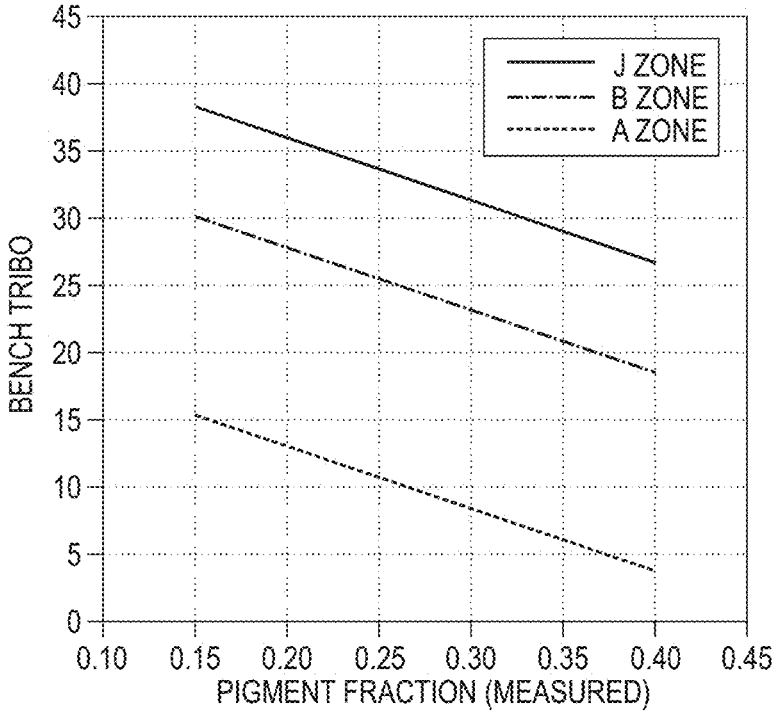
FIG. 3 is a table of exemplary toner particles were evaluated for L* in accordance with exemplary embodiments.
FIG. 4 is a graph showing the results of a triboelectric charging (tribo) analysis of white toner tribo vs. pigment concentration at different zones of environmental humidity.

The triboelectric charging of toners made with different levels of pigment was measured on the bench under different environmental conditions, such as different environmental humidity. From this the inventors plotted the toner's tribo vs pigment concentration to identify a pigment concentration that should not be exceeded to enable acceptable charging characteristics. FIG. 4 depicts the white toner tribo vs. pigment concentration at different zones of environmental humidity. In FIG. 4, the J-zone represents a low temperature-low humidity environment (e.g., about 10% relative humidity and around 60° Fahrenheit), the B-zone represents a lab ambient humidity (e.g., about 50% relative humidity and around 70° Fahrenheit), and the A-zone represents a high temperature-high humidity environment (e.g., about 80% relative humidity and around 80° Fahrenheit). The inventors intentionally designed an exemplary white dry ink pulverized toner so that the tribo in the B-zone is no lower than 20 units. This sets the pigment fraction (PMA) limit to be around 0.37 mg/cm$^2$. The inventors intentionally designed pigment concentration of the exemplary white dry ink pulverized toner based on simultaneous optimization of L* and tribo, and thus determined 25% white pigment for the dry ink pulverized toner design.

Toner Characteristics: Pigment Dispersion

Figure 5:
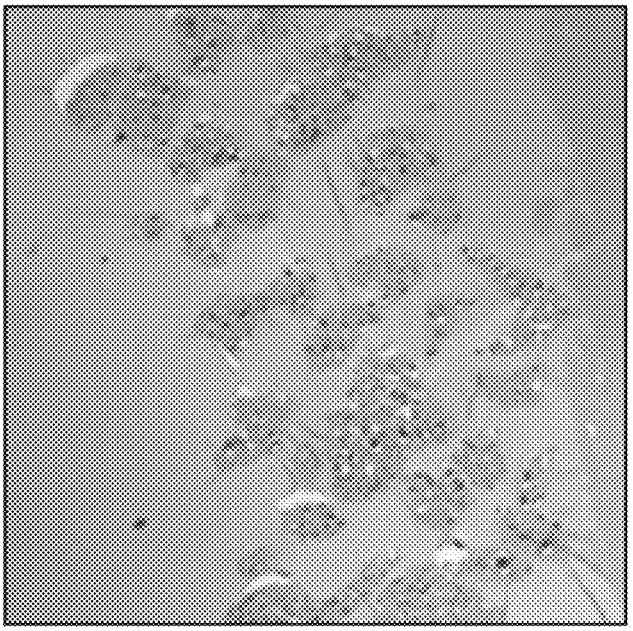
FIG. 5 is a transmission electron microscope (TEM) photograph illustrating a cross-section of a toner particle made from an extruded mix of resin and $TiO_2$ pigment in accordance with an exemplary embodiment.
Figure 6:
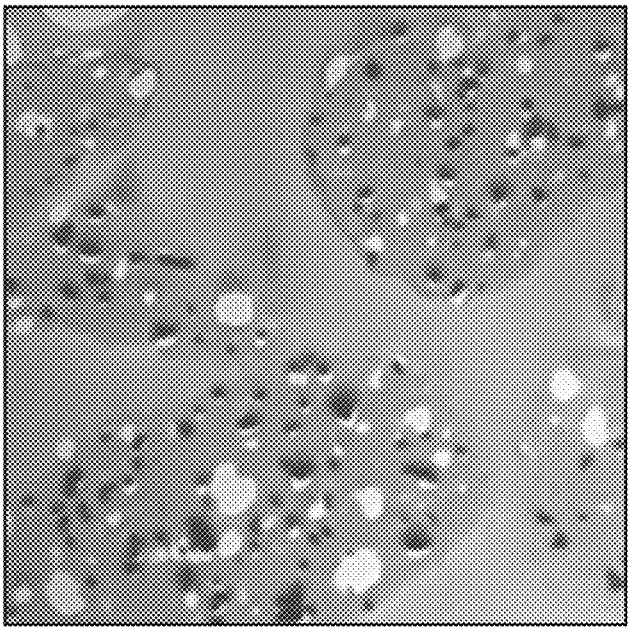
FIG. 6 is a transmission electron microscope (TEM) photograph illustrating an exploded cross-section of a portion of a toner particle made from the extruded mix of FIG. 5 in accordance with an exemplary embodiment.

To enable good hiding power (high L*) the pigment needs to be well dispersed within the polymer phase. This is enabled during the melt mixing of the polymers and pigment in the twin screw extruder. Analysis of the internal morphology of the particles with 25% white pigment shows very good dispersion of the pigment. FIGS. 5 and 6 are transmission electron microscope (TEM) photographs illustrating a cross-section of the extruded mix of an example. The extruded particle mix was cut by an ultramicrotomy blade to form the cross-sectioned images of FIGS. 5 and 6. In FIGS. 5 and 6, the pigment is represented by the dark spots, and the resin is represented by the gray portion. The white spots are an artifact of the image. During this cross-sectioning process, TiO2 pigment may get knocked off the extruded particle mix leaving a white spot as the void where the pigment was supposed to be. The micrographs also suggest that between particles the amount of pigment is very similar, showing good homogeneity of the material at the exit of the extruder. Good dispersion of the pigment is also required to enable a charge distribution that is within the acceptable boundaries of the print system.

Toner Characteristics: Bulk Flow

Basic Flow Energy (BFE) is a measurement of the amount of energy required to trigger flow in a powder bed. The lower the energy, the higher the flow ability of the powder. From a bulk flow point of view, the exemplary toners have similar or potentially better BFE than that of typical toners (CMYK) designed for this type of xerographic printing system. For comparison, typical digital printing system toners have a BFE tested by a powder rheometer (e.g., FT4 Rheometer) ranging from 50 to 70 mJ. White toners of the exemplary embodiments ranging from 20% to 40% pigment have basic flow energy ranging from 39 to 52 mJ.

Toner Characteristics: Additive Attachment

The degree of surface additive attachment is an important parameter in many xerographic printing systems. Several failure modes have been correlated in the past to poor additive attachment, especially silica. We quantified the strength of attachment of the silica additive at different levels of energy applied to the toner particles for different levels of white pigment. The energy is applied on the form of sonic waves with the objective of knocking off the additives. FIG. 7 is a table summarizing the silica additive attachment results. The numbers represent the percentage of additive left attached on the toner after sonic energy is applied. For example, the control toner (0% Cyan) has 62% of initial additive remaining attached on the toner after applying 3K Joules of sonic energy. The data shown in FIG. 7 demonstrates that at 25% pigment the degree of silica attachment is expected to be very similar to that of a standard or typical color toner (in this case Cyan) so no issues related to additive attachment are found in the exemplary toners.

Toner Characteristics: Triboelectric Charging (Tribo)

Triboelectric charging has been assessed at different white pigment levels. The data was generated by pairing the toners against a steel core carrier using a paint shake method at 4% Toner Concentration (TC) as readily understood by a skilled artisan. As noted above, FIG. 4 shows results of a triboelectric charging analysis of white toner tribo vs. pigment concentration at different zones of environmental humidity. Using the model for a 25% pigment (0.25 pigment fraction) predicts the tribo as indicated in the table of FIG. 8. Bench tribo for other colors is included for comparison. The triboelectric charge data shows the white toner with 25% pigment on the lower side, but within the range observed for other colors (e.g., controls) that are currently run in the xerographic printing systems. Small tribo adjustments can be enabled by optimizing the operating toner concentration of the system and additive level optimization. The tribo of toners made from parent particles in Examples 1-6 identified in the table of FIG. 1 are listed in the table of FIG. 9.

Toner Characteristics: Fusing

Figure 10:
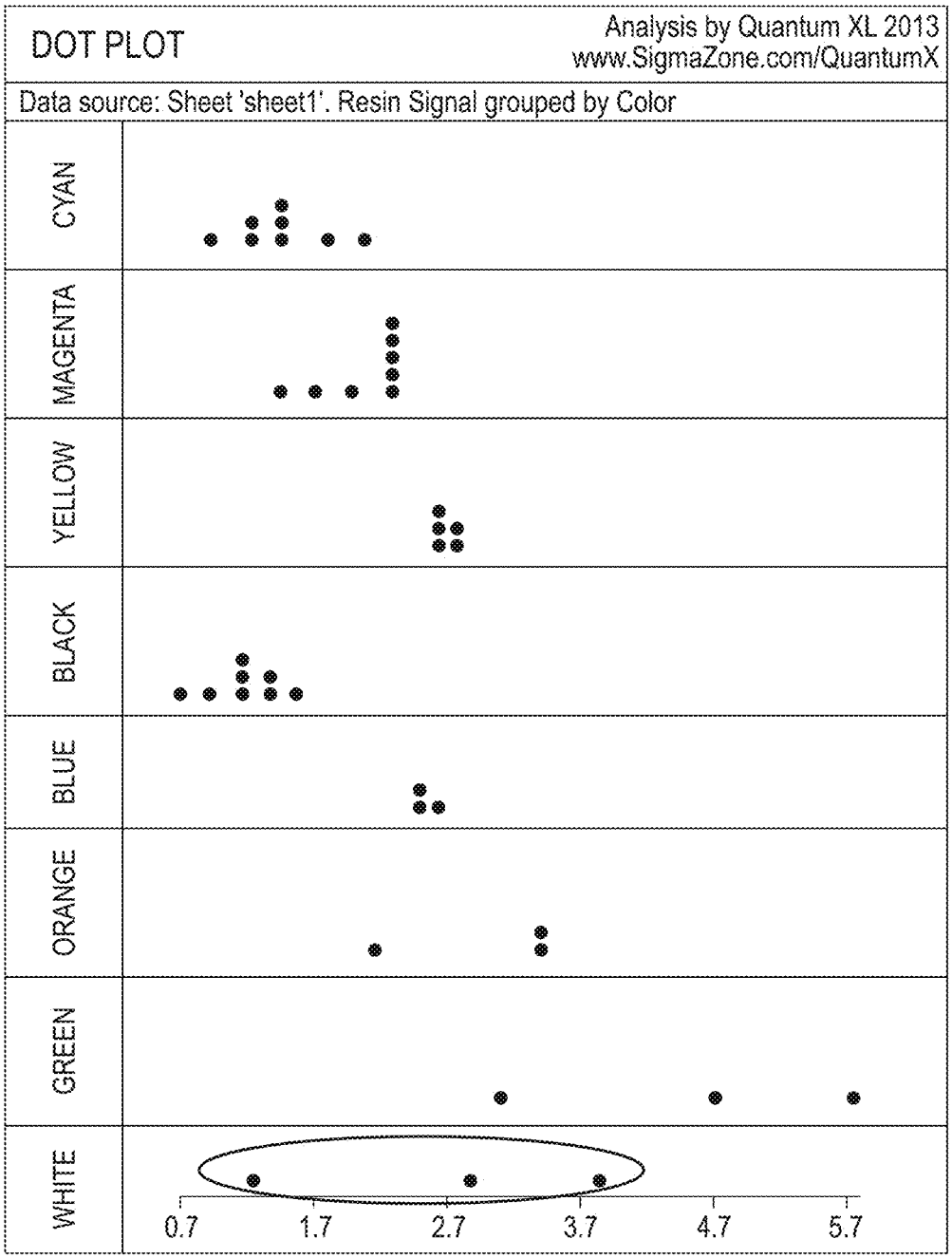
FIG. 10 is a dot plot chart of a resin signal of an exemplary white dry ink pulverized toner on a fuser roll.
Figure 11:
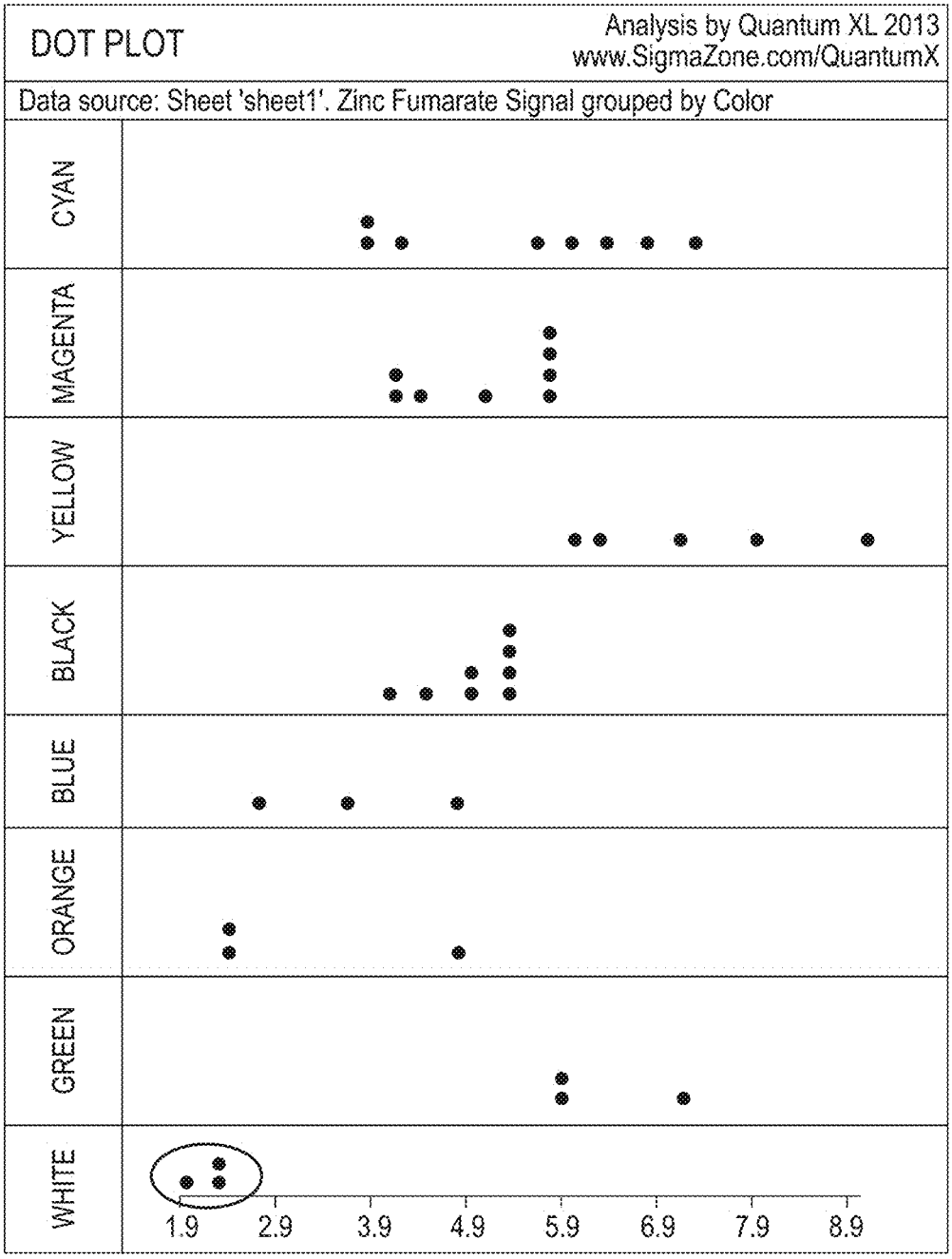
FIG. 11 is a dot plot chart of a Zinc Fumarate signal of an exemplary white dry ink pulverized toner on the fuser roll.

Exemplary white dry ink pulverized toners according to the embodiments have been tested to assess the how the exemplary toners and fuser roll interact. The evaluation consists of running the toner under a controlled mass target and the fuser operating temperature. A stress job is run over a predetermined number of impressions. The fuser roll is then removed from the machine and the extent of toner contamination on the fuser roll is determined from Fourier Transform Infrared (FTIR) Spectroscopy measurements. The FTIR signal strength of resin and Zinc Fumarate on the fuser roll is a good indicator of contamination (hot offset). The signal strength is compared to that from other toners that are used in the field in printing devices having the same fusing subsystem (e.g., fuser roll). FIG. 10 is a dot plot chart of the resin signal on a fuser roll, and FIG. 11 is a dot plot chart of the Zinc Fumarate signal on the fuser roll. As can be observed from the data of FIGS. 10 and 11, the resin and Zinc Fumarate signal from the exemplary white toner is within the range observed for all other toners that are used in the same fusing subsystem. The conclusion is that the potential for fuser roll contamination with exemplary white toner is low and comparable to other color toners.

Print Testing

Figure 12:
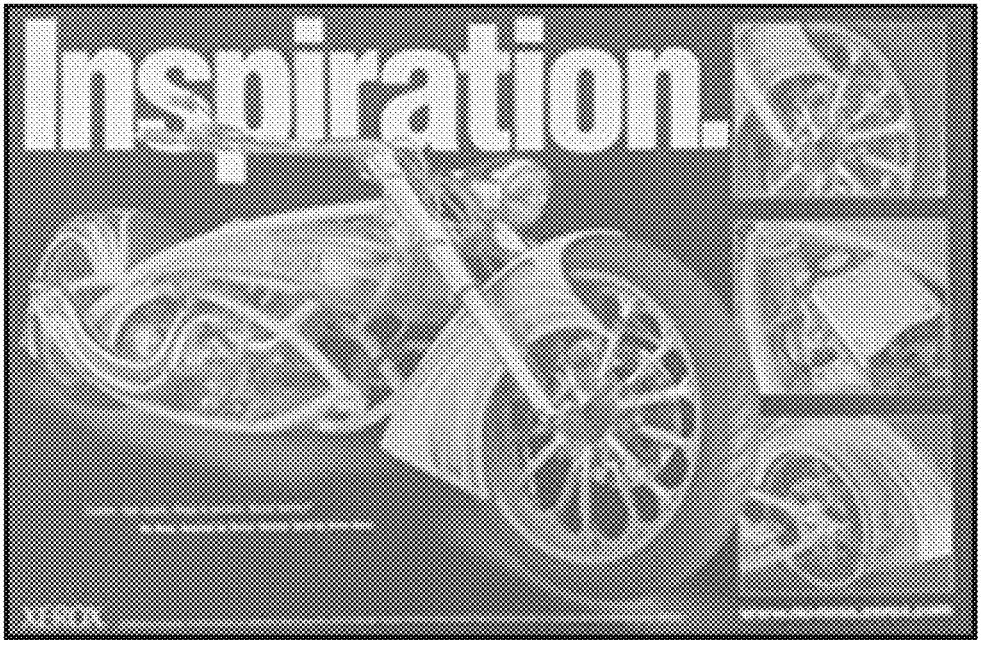
FIG. 12 is an illustration of a print generated with an exemplary white dry ink pulverized toner on a black substrate according to an exemplary embodiment.

FIG. 12 is an illustration of a print generated with an exemplary white dry ink pulverized toner having 25% pigment on a black substrate. The print is an example illustration of prints designed to run with white toner. While not being limited to a particular theory, FIG. 12 shows a typical impression generated with the exemplary white dry ink pulverized toner formulation in the fifth or specialty color station of a color printing system.

To achieve the desired L* target of at least 75 on a black substrate it is typical to run multiple passes. This becomes more challenging when the substrate has no coating or has a high porosity surface. L* measurements of an exemplary white toner on a black uncoated heavy media showed that for a total mass target of 1.2 mg/cm$^2$ an L* target of 75 (solid area) is met. With the system operating at 0.5 mg/cm$^2$ per development pass this confirms that in three development passes the L*target of 75 to nearly 80 can be achieved with the exemplary white toner in three passes.

Although the above description may contain specific details, they should not be construed as limiting the claims in any way. Other configurations of the described embodiments of the disclosed systems and methods are part of the scope of this disclosure. For example, the white dry ink pulverized toner is discussed herein in relation to digital offset printing or variable data lithographic printing systems. Embodiments of the white dry ink pulverized toner may be used in within these printing systems or other printing systems, such as in printing systems having a xerographic station in addition to the typical xerographic stations used in a printing system. For example, a color printing system may have a fifth color or specialty color xerographic station. At any given time the printing device will run CMYK toners plus a fifth color in the fifth station. In such print systems, the exemplary white dry ink pulverized toner formulation may be run in the fifth or specialty color station. The white dry ink pulverized toner can be used for applications where black or colored substrates are used as well as clear packaging. The white dry ink pulverized toner can also be used to enable crisp white solid areas in images where large white solids are to be printed.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A white dry ink pulverized toner, comprising:

a resin and TiO2 pigment combination mixed with the resin in a twin screw extruder resulting in an extruded mix, the extruded mix being pulverized in a fluid bed jet mill and classified to a target median size of from about 6 microns to about 12 microns, the pulverized particles blended in a mixer with surface additives including silica, titania and ZnSt with the silica, titania and ZnSt being greater than 5% mass of the white dry ink pulverized toner, wherein the white dry ink pulverized toner has a developer charge between 5 and 50 μC/gram, a L* of 75-90 measured on a black paper, with a pigment mass per unit area of 0.32-1.00 mg/cm$^2$ at a toner mass per unit area (TMA) of less than or equal to 1.2 mg/cm$^2$, and the TiO2 pigment being 25% to 45% by weight of the total weight of toner particle.

2. The white dry ink pulverized toner of claim 1, the resin includes a combination of a propoxylated bisphenol-A/fumaric acid resin and a gel resin made by crosslinking the propoxylated bisphenol-A/fumaric acid resin.

3. The white dry ink pulverized toner of claim 1, the resin including a propoxylated bisphenol-A/fumaric acid resin with molecular weight (Mw) of 12000-14000 pse and 10-30% of a gel resin made by crosslinking the propoxylated bisphenol-A/fumaric acid resin.

4. The white dry ink pulverized toner of claim 1, wherein the TiO2 pigment has a silica and alumina pre-treatment for dispersion in an organic phase.

5. The white dry ink pulverized toner of claim 1, the surface additives include 3.5% of the silica, 1.6% of the titania, and 0.5% of the ZnSt.

6. The white dry ink pulverized toner of claim 1, wherein the TiO2 pigment has a mean size between 250 nm and 350 nm.

7. The white dry ink pulverized toner of claim 1, the white dry ink pulverized toner has a developer charge between 10 and 45 μC/gram.

8. A method of producing white dry ink pulverized toner, comprising:

mixing and extruding TiO2 pigment with a resin in a twin screw extruder resulting in an extruded mix;

pulverizing the extruded mix in a fluid bed jet mill and classified to a target median size of from about 6 microns to about 12 microns; and adding surface additives including silica, titania, and ZnSt to the pulverized particles and blending the surface additives and pulverized particles resulting in the white dry ink pulverized toner, with the silica, titania and ZnSt being great than 5% mass of the white dry ink pulverized toner, wherein the white dry ink pulverized toner has a developer charge between 5 and 50 μC/gram and a L* of 75-90 measured on a black paper, with a pigment mass per unit area of 0.32-1.00 mg/cm$^2$ at a toner mass per unit area (TMA) of less than or equal to 1.2 mg/cm$^2$, and the TiO2 pigment being 25% to 45% by weight of the total weight of toner particle.

9. The method of claim 8, wherein the resin includes a combination of a propoxylated bisphenol-A/fumaric acid resin and a gel resin made by crosslinking the propoxylated bisphenol-A/fumaric acid resin.

10. The method of claim 8, wherein the resin includes a propoxylated bisphenol-A/fumaric acid resin with molecular weight (Mw) of 12000-14000 pse and 10-30% of a gel resin made by crosslinking the propoxylated bisphenol-A/fumaric acid resin.

11. The method of claim 8, wherein the TiO2 pigment has a silica and alumina pre-treatment for dispersion in an organic phase.

12. The method of claim 8, wherein the surface additives include 3.5% of the silica, 1.6% of the titania, and 0.5% of the ZnSt.

13. The method of claim 8, wherein the TiO2 pigment has a mean size between 250 nm and 350 nm.

14. The method of claim 8, wherein the white dry ink pulverized toner has a developer charge between 10 and 45 μC/gram.

15. An image formed with a white dry ink pulverized toner on a black substrate, the white dry ink pulverized toner including a resin and a TiO2 pigment melt mixed with the resin in a twin screw extruder resulting in an extruded mix, the TiO2 pigment having a mean size between 275 nm and 325 nm, the extruded mix being pulverized in a fluid bed jet mill and classified to a target median size of from about 6 microns to about 12 microns, the pulverized particles blended in a mixer with surface additives including silica, titania and ZnSt with the silica, titania and ZnSt being greater than 5% mass of the white dry ink pulverized toner, the white dry ink pulverized toner having a developer charge between 5 and 50 μC/gram and a L* of 75-90 measured on a black paper, with a pigment mass per unit area of 0.32-1.00 mg/cm$^2$ at a toner mass per unit area (TMA) of less than or equal to 1.2 mg/cm$^2$, and the TiO2 pigment being 25% to 45% by weight of the total weight of toner particle and the resin includes a combination of a propoxylated bisphenol-A/fumaric acid resin and a gel resin made by crosslinking the propoxylated bisphenol-A/fumaric acid resin.

16. The image of claim 15, the resin includes a combination of a propoxylated bisphenol-A/fumaric acid resin and a gel resin made by crosslinking the propoxylated bisphenol-A/fumaric acid resin.

17. The image of claim 15, the resin including a propoxylated bisphenol-A/fumaric acid resin with molecular weight (Mw) of 12000-14000 pse and 10-30% of a gel resin made by crosslinking the propoxylated bisphenol-A/fumaric acid resin.

18. The image of claim 15, wherein the TiO2 pigment has a silica and alumina pre-treatment for dispersion in an organic phase.

19. The image of claim 15, the surface additives include 3.5% of the silica, 1.6% of the titania, and 0.5% of the ZnSt.

20. The image of claim 15, wherein the TiO2 pigment has a mean size between 250 nm and 350 nm.

* * * * *